United States Patent [19]

Landis

[11] 4,101,563

[45] Jul. 18, 1978

[54] PROCESS FOR REFINING CRUDE OIL

[75] Inventor: Joel Victor Landis, Houston, Tex.

[73] Assignee: Petrolite Corporation, St. Louis, Mo.

[21] Appl. No.: 761,753

[22] Filed: Jan. 24, 1977

[51] Int. Cl.[2] ..... C11B 3/06

[52] U.S. Cl. ..... 260/425; 204/167; 204/190; 260/428; 260/418; 210/21

[58] Field of Search ..... 260/417, 418, 425, 426, 260/427, 428; 204/167, 188, 190

[56] References Cited

U.S. PATENT DOCUMENTS

| | | | |
|---|---|---|---|
| 3,356,603 | 12/1967 | Drew | 204/167 |
| 3,575,952 | 4/1971 | Morris et al. | 260/425 |
| 3,673,070 | 6/1972 | Wiley | 204/188 |
| 3,799,857 | 3/1974 | Franse | 204/188 |
| 3,847,774 | 11/1974 | Jarrell | 204/190 |

FOREIGN PATENT DOCUMENTS

| | | | |
|---|---|---|---|
| 327,155 | 1/1972 | U.S.S.R. | 204/167 |

*Primary Examiner*—Winston A. Douglas

*Assistant Examiner*—John F. Niebling

*Attorney, Agent, or Firm*—Sidney B. Ring; Hyman F. Glass

[57] ABSTRACT

An improved process for the refining of crude oil selected from the group of fats, animal and vegetable oils. The crude oil is reacted with aqueous alkali to produce a treated oil with reduced acidic content but containing finely dispersed, liquid-state alkali metal soaps, and a bulk aqueous alkali phase. The bulk alkali phase is separated from the treated oil. The treated oil is subjected to electrofiltration by passage through a bed of dielectric particulate solids having open continuous, but tortuous flow paths, which are interposed within a d.c. electric field having a gradient of at least 20 kv/in whereby the alkali metal soaps adhere in a liquid state to the particulate solids and provide a purified oil with a substantially reduced content of the alkali metal soaps. The purified oil is sent to a subsequent utilization. A dielectric wash liquid is periodically flowed through the bed to remove the priorly adhering finely dispersed alkali metal soaps from the particulate solids.

23 Claims, 1 Drawing Figure

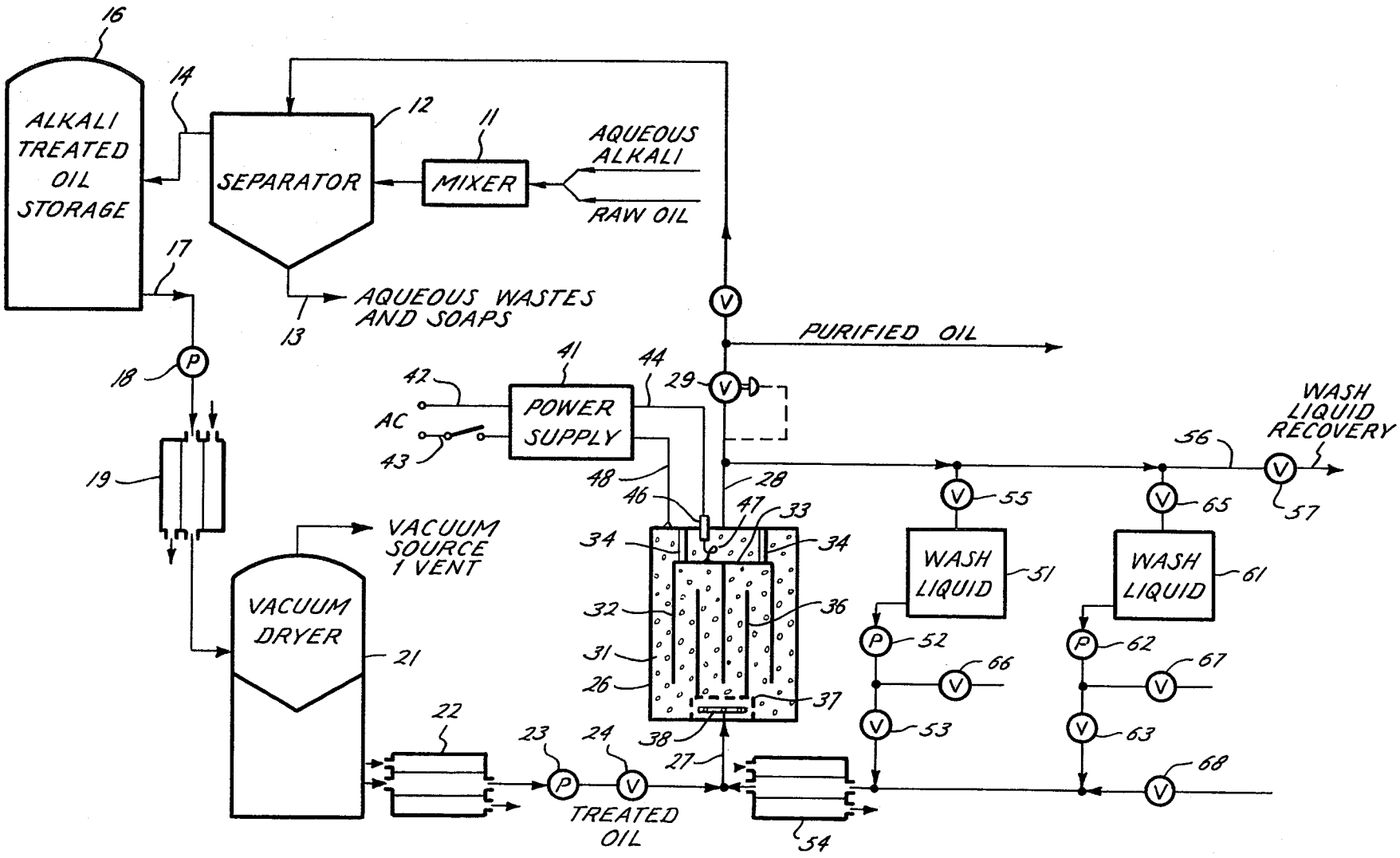
WASH LIQUID RECOVERY
WASH LIQUID
WASH LIQUID
PURIFIED OIL
AQUEOUS ALKALI
RAW OIL
MIXER
SEPARATOR
AQUEOUS WASTES AND SOAPS
POWER SUPPLY
AC
VACUUM SOURCE 1 VENT
VACUUM DRYER
TREATED OIL
ALKALI TREATED OIL STORAGE

PROCESS FOR REFINING CRUDE OIL

BACKGROUND OF THE INVENTION

1. Field of the Invention

This invention related to the processing of nonpetroleum crude oils such as fats, animal and vegetable oils, and more particularly, it relates to an improved process for refining crude oil by a multistep unique treating process.

2. Description of the Prior Art

Many nonpetroleum crude oils (e.g., fats, vegetable and animal oils) are used for human consumption and other utilizations. The crude oil is purified chemically and mechanically to remove solids, to improve chemical properties, color, odor, enhance storage stability and to make a more suitable oil for ultimate utilization. Present day treatment of crude oils consist generally of the steps of refining, hydrogenation, bleaching and deodorization. The term "refining" refers to any purification treatment designed to remove undesirable materials such as free fatty acids, phosphatides, or mucilaginous material, or caustic reactible and acidic impurities in the crude oil.

Most commonly, the refining of the crude oil employs an aqueous alkali, such as sodium hydroxide, to remove the acidic materials and the organic materials capable of undergoing a reaction with the crude oil under controlled reaction conditions so as to induce maximum removal of the acidic and other caustic reactants from the crude oil. Alkali metal soaps and other types of soaplike materials are formed by the caustic reaction with the acidic and other caustic reactants in the crude oil. These caustic reactant materials are in the form of creamlike or mayonnaise-like material with a different soapstock or higher specific gravity as the treated oil. A bulk aqueous phase containing the major portion of the alkali metal soaps is separated from the treated oil. However, the treated oil contains a substantial portion of the alkali metal soaps and the caustic reactant materials. This physical suspension requires an enhanced separation of the alkali metal soaps to a reduced level in the treated oil. Gravity separators, but preferably centrifuges, are employed for this purpose. As a result, the alkali metal soaps content of the treated oil may have been reduced to about 1 percent by weight. Unfortunately, these soaps are most difficult to separate further from the treated oil by physical methods since they are in a finely divided liquid state.

Present day refining practices can use a water-wash for the treated oil to reduce the residual amounts of alkali metal soaps. An intimate mixing of hot water with the treated oil is required followed by bulk phase separation. Then, the water-washed treated oil is subjected to extreme levels of enhanced gravity separation by series flow centrifuges, mechanical filters, or the like. Although the water-wash step does reduce the alkali metal soap content of the treated oil, the refining operator faces four severe problems. A relatively large waste water stream must be processed to recover entrained treated oil which is removed concomitantly with the washing water. Also, the wash water is processed for recovery of the alkali metal salts which create a severe water pollution problem in water handling systems. The wash water increases the free fatty acid content of the treated oil since the water wash and centrifugal separation steps are time domain and cause hydrolysis of neutral oils to occur through their intimate contact with the wash water, especially at elevated temperatures. Needless to say, the refining operator faces costly centrifugal machinery repair and maintenance.

The refinery operator has tried many procedures for avoiding the difficulties existing in the reaction of crude oil with aqueous alkali. Up to the present time, and for the past 80 years, the same basic steps have been employed industry-wise for the reaction of crude oil with aqueous alkali, and the subsequent water-washing of crude oil with oil to reduce the residual content of alkali metal soaps and caustic reactants carried in the treated oil.

The present invention is an improved process for the refining of crude oil wherein the reaction of the crude oil and aqueous alkali may be affected by intimate mixing so that the highest removal of acidic material and caustic reactants occurs without regard to subsequent phase separation procedures. More particularly, this improved process avoids the necessity of water-washing and the expensive centrifugal separation steps heretofore practised in the refinery art. An additional advantage resides in the present improved process wherein residual alkali metal soaps, irrespective of particle size and liquid phase conditions, are substantially removed from a treated oil. This novel process produces a purified oil of high purity with a greatly reduced content of alkali metal soaps. An important advantage in the improved process is the removal of finely divided solid material, such as clays, rust, etc., during the removal of alkali metal soaps. Furthermore, the alkali metal soaps can be recovered separately from these finely divided solid materials.

SUMMARY OF THE INVENTION

In accordance with this invention, there is provided an improved process for the refining of a crude oil selected from the group of fats, animal and vegetable oils. This process has the steps of (a) reacting the crude oil with an aqueous alkali to produce a treated oil with reduced acidic content but containing finely dispersed liquid-state alkali metal soaps, and a bulk aqueous alkali phase, (b) separating the bulk aqueous alkali phase from the treated oil, (c) subjecting the treated oil to electrofiltration by passage through a bed of dielectric particulate solids having open and continuous but tortuous flow paths, interposed within a d.c. electric field having a gradient of at least 20 kv/in whereby the finely dispersed alkali metal soaps adhere in their liquid-state to the particulate solids in the bed and provide a purified oil with a substantially reduced content of the alkali metal soaps, (d) passing the purified oil to a subsequent utilization, and (e) periodically flowing a dielectric wash liquid through the bed to remove the priorly adhering finely divided dispersed alkali metal soaps from the particulate solids. In other embodiments of the present improved process, finely dispersed solid materials can be removed concomitantly with the alkali metal soaps and may be recovered concurrently or separately therewith.

DESCRIPTION OF THE DRAWING

The drawing is a diagrammatic illustration, in flow schematic, of an arrangment of apparatus for carrying out the several steps of the present improved process.

DESCRIPTION OF SPECIFIC EMBODIMENTS

The present improved process for the refining of crude oil will be described relative to one crude oil type, mainly, soybean oil. However, the present process is equally applicable and of utility to other types of crude oils, e.g., fats and animal and vegetable oils. More particularly, the process can be used to especial advantage in the refining of meat fats, various kernel oils, and coconut oils. The drawing illustrates an arrangment of apparatus which can be employed for practising the procedural steps in the present process. However, the apparatus may consist of other elements. There are many well known devices capable of carrying out the listed steps by direct or equivalent functions, and this equipment can be employed with equal effect for the functions and results of the present process.

The improved process for refining crude oil is conducted relative to the drawing with a mixer 11 intimately mixing aqueous alkali into crude oil. The resulting caustic treated oil passes into the phase separator 12 wherein there is produced an underflow 13 of aqueous waste and soaps and an overflow 14 of treated oil containing residual amounts of finely dispersed aqueous alkali metal soaps and caustic reactants. The treated oil may be sent to temporary storage in a vessel 16. The treated oil is taken from the vessel 16 at an outlet 17 and moved by a pump 18 through a heat exchanger 19. The oil's temperature is suitably elevated in exchanger 19 for further processing in a vacuum drier 21, if necessary, wherein the water content of the treated oil is reduced to an amount tolerable for the processing equipment. For example, the treated oil will usually have a free water content of less than 1500 ppm. The new deaerated and dehydrated treated oil from the drier 21 is passed through a heat exchanger 22 to lower the oil's temperature which correspondingly reduces the oil solubility of the alkali metal soaps and caustic reactants. The cooled treated oil is moved by a pump 23 through a control valve 24 and into an electrofilter 26. The electrofilter 26 substantially removes the alkali metal soap and caustic reactant contents from the treated oil and produces in outlet 28 a flow of purified oil. The purified oil is taken from the outlet 28 through a backpressure valve system 29 and is sent to any suitable subsequent utilization such as hydrogenation or product bleaching. Associated with the electrofilter 26 are wash liquid tanks, valves and pumps for periodically cleaning the electrofilter of priorly adhering alkali metal soaps and caustic reactants.

More specifically, mixer 11 receives a charge of soybean oil heated to an elevated reaction temperature of, for example, 150° F. A caustic solution, e.g., 1.5 percent by weight of sodium hydroxide, is added to the soybean oil. The amount of sodium hydroxide used will depend on the free fatty acid content of the oil. Good results are obtained by the use of between 14° and 20° Beaumé caustic. The mixer 11 intimately disperses the caustic into the soybean oil to promote an optimum and thorough reaction for the removal of acidic material and any caustic reactible meaterials. The resultant oil-caustic mixture passes from the mixer 11 into the separator 12 wherein the bulk caustic phase, comprising aqueous wastes and mostly soaps, is removed as the underflow 13. The separator 12 may be of the gravity type, but preferably is a centrifuge wherein gravity enhancement produces a more acceptable treated oil with a reduced content of alkali metal soaps, preferably below 1% by weight. The treated oil from the overflow 14 is held in a vessel 16 for providing a uniform oil flow to the subsequent steps of the present process.

The treated oil is removed from the vessel 16 through outlet 17 and moved by a pump 18 through the heat exchanger 19. Where the free water content is below about 1300 ppm in the treated oil, the treated oil can be passed directly into the electrofilter 26. If the free water content in the treated oil is greater in amounts, or for other reasons, the treated oil should have a higher temperature, usually about 250° F, before being introduced into the vacuum drier 21. At this temperature and the reduced pressure conditions of approximately 26 inches of mercury in the drier 21, deaerating and dehydrating of the treated oil occurs rapidly. The dehydrated and deaerated treated oil is removed from an outlet of the vacuum drier 21 and passed through the heat exchanger 22 where its temperature is reduced to about 200° F. The water vapor and gases are removed through an overhead vent from the vacuum drier 21 and discharged.

The electrofilter 26 preferably receives a flow of treated oil at lower temperatures than usually required for vacuum drying. A temperature of 200° F. has been found satisfactory, although a temperature of about 175° F. gives better results. As a rule, the higher the temperature of the oil, the greater the solubility of the aqueous alkali soaps and other caustic reactants in the treated oil. The treated oil is moved by the pump 23, under suitable pressure to prevent gassing conditions, through the control valve 24 and inlet 27 into the electrofilter 26.

The electrofilter 26 can be a commercial unit such as the Petreco ® Electro-Filter TM Separator. The device is usually constructed of a metal vessel containing inlet 27 and outlet 28 for passage of the oil flow therethrough. The electrofilter includes a bed 31 formed of dielectric particulate solids having open and continuous but tortuous flow paths. Preferably, the dielectric particulate solids are composed of rigid and solid particles having a relatively low dielectric constant, below about 6 at 1 kilohertz. More particularly, these particulate solids should be chemically inert, incompressible, hard and granular in nature. The particulate solids can be a solid mineral containing crystalline silicon dioxide, such as flint, garnet, granite and fused quartz. However, glass beads can be also employed, if desired. The mineral is crushed to provide nonspheroidal configurations which have relatively discontinuous surfaces. For example, crushed flint rock having particle sizes with minimum dimensions between ⅛ and ½ inch are employed to good advantage in the present improved process. The openings in the bed 31 between these particulate solids provide the open and continuous but tortuous flow paths which preferably have an average maximum opening size in bed distribution of not greater than about ⅛ inch. The bed 31 of particulate solids is disposed within a d.c. electric field having a gradient of at least about 20 kv/in. The field can be provided by internested energized and grounded electrodes. A plurality of energized electrodes 32 are supported on a rack 33 by insulators 34 in spaced relationship to a plurality of grounded electrodes 36 mounted upon a rack 37 immediately above a distributor 38 connected to the inlet 27. The energized electrodes 32 receive a suitable d.c. potential from a power supply 41 which is connected to a source of a.c. power by the conductors 42 and 43. The d.c. output of the power supply 41 connects through a high tension conductor 44, entrance bushing 46 and flexible lead 47 to the energized electrodes 32. The ground return 48 of the power supply 41 is connected to the metal vessel of the electrofilter 26.

The treated oil passes from the distributor 38 through the bed 31 to the outlet 28. The electric field provided by the electrodes is of an intensity that the finely dispersed alkali metal soap and caustic reactants in the treated oil are removed by their induced adherence to the particulate solids. The purified oil removed in the outlet 28 from the electrofilter 26 has a substantially reduced content of the finely dispersed alkali metal soaps and caustic reactants. A reduction in the soap content in orders of nearly tenfold can be obtained in one pass through the electrofilter 26. Stated in another manner, the purified oil sent to a subsequent utilization can have a sodium content of only about 3 ppm and a soap content of 24 ppm or less when the treated oil is a magnitude greater in these contents. The oil remains in the electrofilter usually less than 3 minutes. As a result, no significant hydrolysis of soap degradation can occur.

The removal of the finely dispersed alkali metal soaps by the electrofilter 26 is believed to reside in their induced adhesion to the particulate solids by electrostatic forces. These soaps are in a liquid-state with relatively small diameters preferably of a size not greater than the tortuous flow paths through the bed 31. For best results, the treated oil entering the distributor 38 does not have dispersed alkali metal soaps in bulk masses or "slugs" or with particle sizes substantially greater than the flow paths through the particulate solids. The bulk masses or large droplets of alkali metal soaps could cause a temporary blinding of the particulate solids with a substantial increase in pressure drop across the electrofilter 26. When the electrofilter 26 is operating in accordance with the preferred mode previously set forth, there is no significant pressure differences between the inlet 27 and the outlet 28 even when the particulate solids are completely filled with the finely divided alkali metal soaps and caustic reactants.

Concomitantly, with the removal of the alkali metal soaps in the electrofilter 26, any finely divided solid materials carried in the treated oil, such as clays, filter-aids, sand, and rust, will be removed by their tenacious adhesion to the particulate solids of the electrofilter 26. Thus, an additional advantage exists in the present steps of this novel process that the purified oil is simultaneously cleaned of finely divided solid materials.

From observations, it is believed that the purified oil from the electrofilter 26 is substantially reduced in the crude oil content of phosphatides, mucilaginous material and other gross impurities which create difficulties in conventional refining procedures, especially in hydrogenation where these materials are recognized catalyst poisons and hydrogenation reaction perturbators.

The electrofilter 26 becomes "filled up" with soaps, etc. after operating for extended periods of time. At this point, or at other selected times, a dielectric wash liquid is flowed through the bed 31 to remove the priorly adhering, finely dispersed alkali metal soaps from the particulate solids. For this purpose, the valves 24 and 29 are closed. In accordance with the present process, the electrofilter 26 may be regenerated with or without interruption of the electric field within the particulate solids 31.

For example, the electric field remains applied to the particulate solids and a suitable wash liquid is taken from tank 51, passed through a pump 52, block valve 53, and heat exchanger 54 into the inlet 27 of the electrofilter 26. The wash liquid should be a dielectric fluid such as the purified oil previously prepared in the electrofilter 26. However, the treated oil which is the normal feed for the electrofilter 26 may also be employed. Other types of crude oils, treated or purified oil can be employed, but these oils should be relatively water-free (below about 1300 ppm) and have a relatively high specific resistivity of at least 50,000 ohm.cm. The heat exchanger 54 raises the temperature of the wash liquid to at least, but preferably above, the temperature of the treated oil previously cleaned in the electrofilter 26. For example, if the treated oil had been processed at about 200° F, the wash liquid should be at a temperature of about 50° greater or at about 250° F. Elevated temperatures of the wash liquid not only serve to reduce the viscosity of the oil but serve to soften, solubilize and otherwise enhance the ability of the wash liquid to remove the adhering alkali metal soaps and caustic reactants from the particulate solids. The flow of the heated wash liquid through the particulate solids removes the adhering alkali metal soaps even in the presence of the electric field. The outlet 28 carries the wash liquid with the alkali metal soaps from the electrofilter 26. This stream can be recycled to the tank 51 or sent through the outfall line 56 and block valve 57 to a suitable wash liquid recovery system which may be a phase separator. The amount of the wash liquid passing in outfall line 56 usually is not more than about three volummetric liquid capacities of the electrofilter 26 for a thorough cleaning of the alkali metal soaps and caustic reactants from the particulate solids in bed 31.

An optional second wash system employing tank 61 is also shown in the drawing in addition to the primary wash system employing tank 51.

After the alkali metal soaps are removed from the particulate solids, the d.c. electric field in the particulate solids 31 may be interrupted by de-energizing the power supply 41. The valves associated with the wash liquid tank 51 are closed, and a second source of wash liquid from a tank 61 is preferably employed. However, the wash liquid from the tank 51 could be employed. The wash liquid in the tank 61 is passed through the pump 62, valve 63 and the heat exchanger 54 into the electrofilter 26. This wash liquid may be the priorly described wash liquid, but preferably, a relatively solids-free material is employed, such as the purified oil previously prepared in the electrofilter 26. The wash liquid may be adjusted in temperature in heat exchanger 54 but need not be higher in temperature than the previously employed wash liquid. The wash liquid passes through the electrofilter, at suitable rates and magnitudes, to remove any finely divided solid materials adhering to the particulate solid materials. The wash liquid and solids are removed from the electrofilter 26 through the outlet 28 and passed into the outfall line 56 and valve 57 to a wash liquid recovery system, which may be mechanical filtration using a precoated filter. Alternatively, the wash liquid is recirculated from the line 56 through a block valve 55 and returned into the wash liquid tank 61. After the particulate solids are cleaned of the adhering finely divided solid materials, the mentioned valves relative to tank 61 are closed since the electrofilter 26 now is filled with purified oil. The electrofilter 26 can be returned immediately to service for cleaning treated oil. Alternatively, the wash liquid from the tank 61 can be circulated through the electrofilter 26 with the electric field reapplied by energizing the power supply 41 until purified oil appears in the outlet 28. At this time, the valves associated with the wash liquid tank 61 are closed, the valves 24 and 29 opened, and treated oil again passes through the electrofilter 26 to provide the purified oil. Thus, there is practically no loss of the purified oil or wash liquid.

As has been described, the electrofilter 26 is cleaned periodically in a manner to remove separately the alkali metal soaps and any finely divided solid materials which were carried in the treated oil. If desired, the electrofilter 26 can be regenerated with the conjunctive removal of both the soaps and solid materials by terminating the electric field within the particulate solids and regenerating the system employing the wash liquid in tank 61 in accordance with the described cleaning steps. In this case, the wash liquid flowing into outfall line 56 carries both alkali metal soaps and any finely divided solid materials. As a result, the wash liquid system is adapted to the proper disposition of all these combined materials at high concentration levels.

In many cases, the buildup of solids level in, or a loss of, wash liquid occurs. For these reasons, the wash liquid tank 51 can receive additional inventory from an external supply through the block valve 66. In a similar manner, the wash liquid tank 61 can receive additional inventory of wash liquid through the block valve 67. Alternatively, wash liquid or other fluid, can be introduced into the system using the block valve 68 and passed through the heat exchanger 54 into the electrofilter 26. This fluid introduction arrangement is an asset should the electrofilter 26 be inadvertently contaminated with caustic, excessive amounts of water or for other reasons. The valves 66 and 67 also can be used to send wash liquid to external storage or treatment systems.

The improved process was practised in an oil refinery containing an experimental electrofilter and washing system and provided examples of the outstanding results obtained in the refining of crude oil. The refinery provided commercial streams of treated oil. A slipstream of the treated oil after dehydration and deareation was sent through the pilot plant sized electrofilter. The electrofilter was formed by a cylindrical metal vessel having a 15 inch internal diameter with a 30 inch total vertical height. The vessel had an upright flow axis with nested cylindrical metal electrodes substantially as shown in the drawing. The electrodes were concentric in position with a meshed length of 14 inches. The electrodes defined a bed of particulate solids having a volume of 1.4 cubic feet. The power supply energized selectively the electrodes to d.c. fields of between 20 and 40 kv/in. Treated soybean oil (priorly reacted with caustic) was taken as a 15 gpm slipstream from the commercial refinery operation. The treated oil was produced from de-gummed soybean oil at temperatures between 140° and 160° F and intimately contacted with approximately 1.5 percent by weight of between 14° and 20° Beaumé caustic solution for the extraction of acidic materials and other materials reactant with caustic. The treated oil, and the purified oil produced by the electrofilter, was analyzed according to standard analytical techniques. The particulate solids in the electrofilter were a commercial media, Flintabrasive material formed of crushed and screened flint rock with an average (50 percentile) particle size in minimum dimension of 2.5 millimeters. The media was a crystalline solid dioxide having specific gravities between about 2.5 and 2.9, dielectric constant less than about 5 (at 1 kilohertz), and having a high dielectric strength. The media was scrupulously cleaned prior to introduction into the electrofilter so no contaminants or extraneous solid material were present. The treated oil was passed through the electrofilter at a temperature of about 180°–185° F and at a nominal rate of rise of about 10 inches per minute with a residence time of less than about 3 minutes. The electric field was above 20 kv/in with the nominal energizing potential of about 30 kv/in. The following Table I tabulates the data from the experimental practise of the present process and makes comparison between the treated oil, and the purified oil from the electrofilter.

Table I

| | Treated Oil | Purified Oil |
|---|---|---|
| Acetone Turbidity, ppm | 245 | 35 |
| Soap, ppm | 67 | 24 |
| Sodium, ppm | 20.12 | 3.00 |
| Impurities (filter paper) | 5 | 10 |
| Suspended Solids, ppm | 456.6 | 19.4 |
| Iron, ppm | 6.17 | 0.084 |
| Nickel, ppm | 1.08 | 0.10 |
| Copper, ppm | 0.0 | 0.005 |

The above results of this experimental practise of the present invention show the substantial removal of the alkali metal soaps and caustic reactants from the treated oil by the process of the present invention. These outstanding results go far beyond conventional refining capabilities employing centrifuging, water washing, etc. The soap content of the purified oil was reduced to the level of 65% of the treated oil. Correlation of the purified oil to the soap content of treated oil shows a 90% removal in accordance with the analysis for sodium. In addition, there was a vast reduction in the suspended solids content between the treated and purified oils. The removal of other impurities occurred simultaneously with the alkali metal soaps as shown by the substantial improvement in filter paper impurities to the commercial acceptable grade of 10 for the purified oil.

The great improvement relating to the impurities contribution to color shown in the filter paper test are believed to reside in the removal of certain color bodies reactant with caustic. In addition, the correlation between this test and the acetone turbidity illustrates that the present improved process also substantially reduces the amounts of caustic reaction organic materials which include phosphatides or mucilaginous material and other deleterious materials carried in the treated oil. Thus, the purified oil produced by the present process has far superior properties than oil produced by water washing and centrifuge or filtering techniques in conventional oil refining.

From the foregoing, it will be apparent that there has been provided an improved process for the refining of crude oil which not only avoids the conventional water washing and centrifuging operation, but provides a substantially superior process and product by a unique arrangement of process steps. In addition, this improved process can provide not only for the removal of alkali metal soaps and any solid materials in a treated oil, but also that these materials can be separately recovered after electrofiltration. Many additional improvements are effected in the purification of treated oil which improve subsequent product quality and avoid conventional but expensive additional refining steps for the purified oil. It is to be understood that certain features and alterations of the present process may be employed without departing from the spirit of this invention. This alteration is contemplated by, and is within, the scope of the appended claims. It is intended that the present description is to be taken as an illustration of the present improved process of refining oils.

What is claimed is:

1. A process for refining crude oil selected from the group consisting of fats and animal and vegetable oils, comprising the steps of:

(a) treating said crude oil with aqueous alkali to produce a treated oil with reduced acidic content but containing finely dispersed liquid-state alkali metal soaps and a bulk aqueous alkali phase;

(b) separating the bulk aqueous phase from the treated oil;

(c) subjecting the treated oil to electrofiltration by passing it through a bed of dielectric particulate solids having open but tortuous flow paths interposed within a d.c. electric field, whereby the finely dispersed alkali metal soaps adhere in their liquid state to the particulate solids in the bed and provide a purified oil with a substantially reduced solids content; and (d) withdrawing said purified oil.

2. The process of claim 1 where the electric field is periodically interrupted and a dielectric wash liquid is circulated through said bed of dielectric particulate solids to remove adhering solids.

3. The process of claim 2 wherein the gradient of the d.c. electric field is at least 20 kv/in.

4. The process of claim 3 wherein the aqueous alkali and raw oil in step (a) are intimately mixed with sufficient shear and mixing energy whereby the treated oil contains a substantial amount of the finely dispersed alkali metal soaps in average particle sizes not greater than ⅛ inch.

5. The process of claim 3 wherein the aqueous alkali and raw oil in step (a) are intimately mixed at temperatures not substantially above about 250° F.

6. The process of claim 3 wherein said dielectric wash liquid is passed through the bed until substantially all of the priorly adhering alkali metal soaps are removed in the wash liquid flow.

7. The process of claim 6 wherein the flow of wash liquid passing through the bed is adjusted in temperature to a valve above the temperature of the treated oil so that the alkali metal soaps in the bed are less viscous, softened and solubilized in the wash liquid to enhance their removal from the bed.

8. The process of claim 1 wherein the d.c. electric field has a gradient of at least 20 kv/in and the bed of particulate solids is cleaned without interruption of the electric field, by circulating a dielectric wash liquid through the electrofilter bed to remove adhering solids.

9. The process of claim 8 wherein after removal of the adhering alkali metal soaps from the bed, the electric field is interrupted and a flow of wash liquid is passed through the bed at a sufficient rate and amount to remove from the bed substantially all finely divided solid material carried in the treated oil subjected to electrofiltration.

10. The process of claim 6 wherein the temperature of the wash liquid passed into the bed to remove adhering alkali metal soaps is at least 50° F above the temperature of the treated oil.

11. The process of claim 2 wherein the wash liquid is treated oil.

12. The process of claim 2 wherein the wash liquid is crude oil.

13. A process for the refining of crude oil selected from the group consisting of fats and animal and vegetable oils comprising the steps of:

(a) intimately mixing with sufficient shear and mixing energy the crude oil with an aqueous alkali to produce a treated oil with reduced acidic content but containing finely dispersed alkali metal soaps and an aqueous alkali phase carrying a portion of the alkali metal soaps;

(b) separating the aqueous alkali phase from the treated oil;

(c) subjecting the treated oil to electrofiltration by passage through a bed of dielectric particulate solids having open continuous but tortuous flow paths in which the average largest distance between the particulate solids is not greater than about ⅛ inch interposed within a d.c. electric field having a gradient of at least 20 kv/in whereby the finely dispersed alkali metal soaps adhere in their liquid state to the particulate solids in the bed and provide a purified oil with a substantially reduced content of the alkali metal soaps;

(d) withdrawing the purified oil; and (e) periodically flowing a dielectric wash liquid through the bed to remove the priorly adhering finely dispersed alkali metal soaps from the particulate solids.

14. The process of claim 13 wherein the bed of particulate solids is cleaned in step (e) by interrupting the electric field and passing the wash liquid through the bed until substantially all of the priorly adhering alkali metal soaps are removed in the wash liquid flow.

15. The process of claim 14 wherein the flow of wash liquid passing through the bed is adjusted in temperature to a value above the temperature of the treated oil so that the alkali metal soaps in the bed are less viscous, softened and solubilized in the wash liquid to enhance their removal from the bed.

16. The process of claim 13 wherein the bed of particulate solids is cleaned in step (e) without interruption of the electric field and adjusting the temperature of the wash liquid passing through the bed to a value substantially above the temperature of the treated oil whereby the alkali metal soaps in the bed are less viscous, softened and solubilized in the wash liquid to enhance their removal from the bed while any finely divided solid materials concomitantly removed from the treated oil remain adhering to the particulate solids by action of the electric field.

17. The process of claim 16 wherein after removal of the adhering alkali metal soaps from the bed, the electric field is interrupted and a flow of wash liquid is passed through the bed at a sufficient rate and amount to remove from the bed substantially of all finely divided solid material carried in the treated oil subjected to electrofiltration.

18. The process of claim 14 wherein the temperature of the wash liquid passed into the bed to remove adhering alkali metal soaps is at least 50° F above the temperature of the treated oil.

19. The process of claim 13 wherein the wash liquid is treated oil.

20. The process of claim 13 wherein the wash liquid is crude oil.

21. The process of claim 8 wherein the temperature of the wash liquid is adjusted to a temperature substantially above the temperature of the treated oil, whereby the alkali metal soaps in the bed are less viscous, softened and solubilized in the wash liquid to enhance their removal from the bed while any finely divided solid materials removed from the treated oil remain adhering to the particulate solids by action of the electric field.

22. The process of claim 8 wherein the wash liquid is treated oil.

23. The process of claim 8 wherein the wash liquid is crude oil.

* * * * *

UNITED STATES PATENT AND TRADEMARK OFFICE

CERTIFICATE OF CORRECTION

PATENT NO. : 4,101,563

DATED : July 18, 1978

INVENTOR(S) : Joel Victor Landis

It is certified that error appears in the above-identified patent and that said Letters Patent are hereby corrected as shown below:

Column 2, line 10, delete "with oil"

Column 9, line 45, change "valve" to
--- value ---

Signed and Sealed this

*Sixth* Day of *February 1979*

[SEAL]

*Attest:*

RUTH C. MASON
*Attesting Officer*

DONALD W. BANNER
*Commissioner of Patents and Trademarks*